US005918438A

United States Patent [19]

South

[11] Patent Number: 5,918,438

[45] **Date of Patent: *Jul. 6, 1999**

[54] DOME TYPE BUILDING AND METHOD OF MAKING SAME

[76] Inventor: David B. South, Rte. 1, P.O. Box 24D, Italy, Tex. 76651

[ * ] Notice: This patent issued on a continued prosecution application filed under 37 CFR 1.53(d), and is subject to the twenty year patent term provisions of 35 U.S.C. 154(a)(2).

[21] Appl. No.: 08/842,606

[22] Filed: Apr. 15, 1997

[51] Int. Cl.[6] ..... E04B 1/34; E04G 21/14

[52] U.S. Cl. ..... 52/745.07; 52/2.15; 52/80.1; 52/309.9; 264/32

[58] Field of Search ..... 52/2.15, 309.9, 52/405.1, 745.07, 745.08, 80.1; 264/32

[56] References Cited

U.S. PATENT DOCUMENTS

| | | | |
|---|---|---|---|
| 2,223,418 | 12/1940 | Hewett | 52/745.07 X |
| 2,335,300 | 11/1943 | Neff . | |
| 2,820,990 | 1/1958 | Johnson . | |
| 3,277,219 | 10/1966 | Turner . | |
| 3,292,338 | 12/1966 | MacClarence et al. . | |
| 3,462,521 | 8/1969 | Bini | 52/2.15 X |
| 3,668,287 | 6/1972 | Mackie . | |
| 3,918,233 | 11/1975 | Simpson | 52/745.07 |
| 3,968,604 | 7/1976 | Hills | 52/745.07 X |
| 3,996,320 | 12/1976 | Bini . | |
| 4,077,177 | 3/1978 | Boothroyd et al. | 52/745.07 |
| 4,155,967 | 5/1979 | South et al. | 52/2.15 X |
| 4,170,093 | 10/1979 | Cappellini et al. | 52/745.07 |
| 4,324,074 | 4/1982 | South et al. | 52/2.15 |
| 4,442,059 | 4/1984 | Boyce | 52/2.15 X |
| 4,723,751 | 2/1988 | Hale . | |
| 5,094,044 | 3/1992 | Dykmans | 52/2.15 X |
| 5,188,690 | 2/1993 | Daussan et al. | 52/2.15 X |
| 5,579,609 | 12/1996 | Sallee | 52/2.15 X |

*Primary Examiner*—Carl D. Friedman
*Assistant Examiner*—Timothy B. Kang
*Attorney, Agent, or Firm*—Welsh & Katz, Ltd.

[57] ABSTRACT

A dome building structure employs an inflatable form having a peripheral edge secured to a base. A network of cable-like members overlies the form and is secured to the base so as to restrain pressurized inflation of the form to prevent tearing. A layer of insulating foam is applied to the inner surface of the inflated form followed by attachment of a reinforcing mesh and application of a cementitious layer sufficient to embed the mesh. Internal ribs are formed to directly underlie the network of external cable members which may be interconnected to the internal ribs to assist in support of the ribs until they become self-supporting of the dome. The external network of cable-like members allows the form to extend convexly outwardly or pooch through interstices in the cable network creating smaller radii of curvature to better withstand inward buckling.

23 Claims, 3 Drawing Sheets

106
108
110
110
108

94
96
96
98
98
96
98

94
98
98
98
98
102
104
100
96
102
104
100
96
102
104
100
96

106
108
110

112
114
116
118
118
118
114

112
116
116
114
118
118
114

DOME TYPE BUILDING AND METHOD OF MAKING SAME

BACKGROUND OF THE INVENTION

The present invention relates generally to dome type building structures, and more particularly to an improved dome structure and method of making same which enable on-site construction of dome buildings of substantially greater size than heretofore obtainable.

Dome type building structures made by inflating an inflatable form and applying an insulating foam material interiorly of the inflated form followed by securing a reinforcing mesh to the foam layer and applying one or more layers of a cementitious material to the foam layer so as to embed the reinforcing mesh are generally known. See, for example, U.S. Pat. Nos. 3,277,219 and 4,155,967 that are incorporated herein by reference. In many applications, such structures provide significant economic advantages over conventional building constructions employing lumber, bricks, concrete blocks and the like and taking conventional rectangular or other generally square corner structural configurations. The economic advantages of buildings constructed with inflatable forms having insulation foam and concrete layers applied to their inner surfaces derive in part from the relatively short period required to construct such buildings as compared with conventional building techniques. In general, such dome type building structures are made by securing the periphery of the inflatable form to a footing or foundation, inflating the form, applying an insulating foam layer against the interior surface of the inflated form as by spraying, attaching a relatively rigid reinforcing grid or mesh to the interior surface of the cured foam layer, and thereafter applying one or more cementitious layers, again as by spraying, to the foam layer so as to embed the reinforcing mesh and provide a self-supporting shell-like dome structure.

Dome shaped building structures of the aforedescribed type have proven to be structurally sound and particularly environmentally compatible due to their relatively high thermal efficiency. One drawback to these known dome structures is that they are restricted in size. As the inflatable form is made larger to produce a larger diameter dome, such as a diameter exceeding 300–400 feet, the higher air pressure required to inflate and raise the heavier form may cause the form to tear. In addition, if the wall thickness of a large size dome shell is made sufficiently thick to theoretically provide the necessary strength for self-support, the weight of the additional concrete may exceed its increased strength so that inward buckling occurs, generally termed "snap through" or "oil can" buckling.

Attempts have been made to overcome the size limitations of dome-type buildings by employing a rigid skeletal framework of struts or tubular members to define the contour of the desired building. See, for example U.S. Pat. No. 4,442,059. The struts or tubular members are secured together at intersections by clamps with the lower struts fixed to a base or foundation. An air-impervious membrane envelope is provided within the framework and is inflated to place the struts or tubular members in tension. A coating, such as a fiber-reinforced resin or cement, is applied to the outside surface of the membrane to cover both the membrane and framework. After the desired coating thickness is allowed to set, the air pressure is released and the membrane removed whereupon the struts or tubular members return to a non-tensioned state and detach from the exterior coating material on the membrane. The inner surface of the construction may then be sprayed with resin to cover at least the strut connecting clamps.

U.S. Pat. No. 5,408,793 discloses a dome structure wherein a membrane is inflated to a desired dome shape against radial members made of steel wire, wire rope or glass or carbon fibers and having their bottom ends secured to a base on which the dome is built. The interior and exterior surfaces of the inflated membrane are coated with a rigidifying material such as shotcrete which hardens to form a structural composite layer with the membrane and radial wires embedded in the rigid composite layer. Circumferential high-tensile tensioning elements may be applied around the structure internally of the composite layer to counteract outwardly directed bursting forces created by materials contained within the finished dome.

While the dome structures of the type disclosed in U.S. Pat. Nos. 4,442,059 and 5,408,793 have enabled domes of larger size to be constructed, they have not altogether eliminated the problem of snap-through or oil can buckling when very large domes, such as domes having base diameters significantly greater than 300 feet, are constructed. Such domes have the further disadvantage that they are relatively complex and expensive to make, as compared to a dome structure as disclosed in U.S. Pat. No. 4,155,967. Thus, a dome structure of the type disclosed in the latter patent but which can be built to a relatively large size without significantly increasing the wall or shell thickness would provide a substantial advance in the dome building art.

SUMMARY OF THE INVENTION

A general object of the present invention is to provide a novel dome building structure and method for making same that enable a substantially larger size shell-like dome structure to be constructed than heretofore obtainable.

A more particular object of the present invention is to provide a shell-like dome building structure and method of making same that employ an inflatable form and a novel arrangement of exterior restraining members and internal ribs to provide support strength for large size domes while enabling a relatively thin shell or wall thickness to be formed which is resistant to inward snap-through or oil can buckling.

In constructing a relatively large size dome-type building in accordance with the present invention, such as a dome building structure having a base diameter significantly greater than approximately 300 feet, the peripheral edge of an inflatable form is secured to a base or foundation over which the dome is to be built. A network of external cable-like elements is secured to the foundation so as to overlie the inflatable form and restrain expansion of the form under pressure that could otherwise tear the form. After inflating the form, a layer of insulating foam is applied to the inner surface of the form and allowed to cure. Reinforcing mesh or bars, generally termed rebar, are then secured to the foam layer and a cementitious material, such as shotcrete, is applied, as by spraying, to the foam layer so as to imbed the rebar. As the rebar is attached to the foam layer, rebar cages are also attached to the foam layer so as to establish a pattern of ribs that underlie the external network of cable-like elements. Cementitious material is applied to the cages which are progressively increased in size to create internal ribs of sufficient strength to support the weight of the dome. The exterior cables may initially be connected to the interior rib cages at load points of the ribs, but may be removed when the ribs are of sufficient strength to support the load of the dome or may be retained as ornamentation.

A feature of the dome building structure and method of making same in accordance with the invention lies in the employment of an external network of cable-like members or elements and a corresponding network of internal ribs immediately underlying the external cable-like elements. Both the external network of cable-like elements and the internal ribs may take various geometric patterns so that the external cable-like elements restrain the inflatable form from tearing apart due to internal pressure during inflation, and the internal ribs provide internal self-support for the dome when completed and the internal pressure is released.

Further objects, features and advantages of the present invention will become apparent from the following detailed description of the invention taken with the accompanying drawings wherein like reference numerals designate like elements throughout the several views.

DETAILED DESCRIPTION

Figure 1:
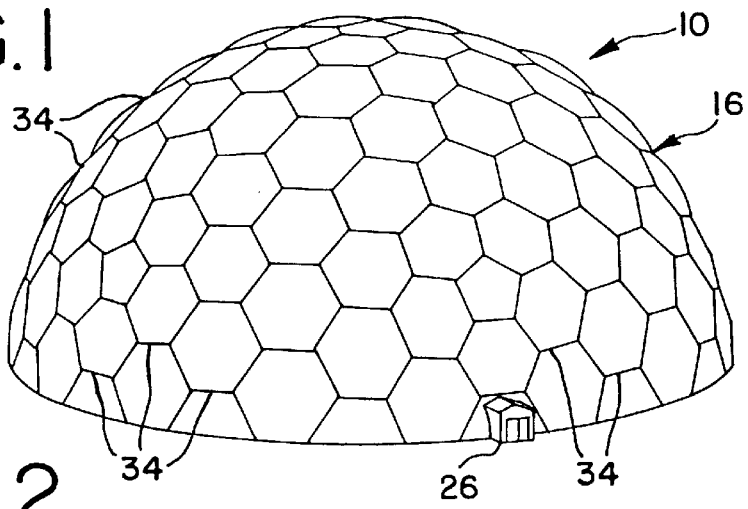
FIG. 1 is a perspective view of a dome type building structure constructed in accordance with one embodiment of the present invention.
Figure 2:
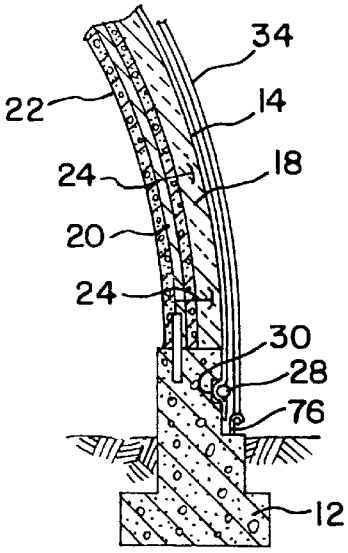
FIG. 2 is a representative fragmentary vertical sectional view, on an enlarged scale, through the peripheral foundation and a portion of the upstanding wall of the dome structure of FIG. 1.

Referring now to the drawings, and in particular to FIGS. 1 and 2, a dome type building structure constructed in accordance with one embodiment of the present invention is indicated generally at 10 in FIG. 1. The dome type building structure 10 illustrated in FIG. 1, which may hereafter be referred to simply as a dome or dome building, takes the form of a generally semi-spherical shaped dome building having a circular base defined by a footing or foundation 12 (FIG. 2) that is preferably formed from concrete to establish the desired base diameter and is sized to support the weight of the dome and to withstand various weather and environmental conditions to which the dome building may be subjected.

Briefly, the dome building 10 is constructed by first laying the footing 12 after which an air-impervious inflatable form 14 is secured at its peripheral edge to the footing in an air-tight relation therewith. External restraining means in the form of a network of external restraining members, indicated generally at 16, is secured to the footing or foundation 12 so that the network of restraining members overlies the inflatable form 14. The network of restraining members 16, alternatively termed restraining elements, is configured to allow pressurized inflation of the form but restrain the extent of outward inflation under pressure to a desired configuration and size so that tearing or rupture of the pressurized form is prevented.

After inflating the form 14 against the network of restraining members 16, a layer of insulation material 18, such as plastic foam, is applied against the inner surface of the inflated form and allowed to cure. A reinforcing mesh 20, such as a suitable metallic mesh or reinforcing bar arrangement ("rebar"), is secured to the inner surface of the insulation foam layer 18 in relatively close proximity thereto by means of a plurality of hanger bars, indicated at 24 in FIG. 2, as described in U.S. Pat. No. 4,155,967 which is incorporated herein by reference. A layer of cementitious material 22, such as concrete or shotcrete, is then applied to the inner surface of the foam layer in progressive built-up layers so as to embed the reinforcing mesh 20. When cured or set, the foam, reinforcing mesh and cementitious layers create a composite dome wall taking the form of the desired dome shape, such as a generally semi-spherical dome having a nominal radius of curvature preferably equal to or greater than the radius of the circular foundation 12. As illustrated in FIG. 1, the network of restraining members 16 defines open areas or interstices between the various restraining cable members. This allows the form 14 to extend or pooch outwardly of the open areas in convex or bubble-like fashion. The outwardly convex bubble-like portions have smaller radii of curvature than the nominal diameter of the overall dome so as to better resist inward buckling of the dome wall. Alternatively, the dome may be oblong, elliptical, or semi-barrel shaped with various vertical sections of the dome transverse to its longitudinal axis having different radii of curvature.

The plastic insulation foam layer 18 and built-up cementitious layer 22 are preferably formed on the inner surface of the inflatable form 14 by spraying techniques as described more fully in U.S. Pat. No. 4,155,967. The illustrated dome building structure 10 includes access means in the form of an entrance door or pair of doors 26, it being understood that the access means is formed in a manner so as not to impede inflation of the form 14 and may take substantially any desired configuration and size. Windows and/or sky lights and ventilation openings (not shown) may be provided in the finished dome building as is known.

Figure 4A:
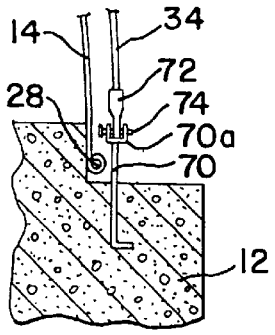
FIGS. 4A, 4B and 4C are fragmentary vertical sectional views illustrating various techniques for releasably connecting the external restraining cables to the foundation of the dome structure of FIG. 1.

The inflatable form 14 is preferably made from a lightweight air and liquid impermeable flexible sheet or membrane such as a cross laminate plastic, a reinforced plastic coated fabric such as polyvinyl chloride impregnated Dacron, or other suitable material. The peripheral edge of the form 14 may be releasably secured in air tight relation to the footing or foundation 12 by a suitable clamping cable or band 28 that extends about the foundation. The lower peripheral edge of the inflatable form may be retained within a peripheral groove 30 formed in the footing or foundation, as shown in FIG. 2, or secured against a peripheral vertical surface on the foundation as shown in FIG. 4A.

The dome building 10 may be formed in situ of substantial size. For Example, the building 10 may have a base diameter substantially in excess of 300 feet, such as upwards of approximately 1000 feet or even greater. A barrel shaped dome configuration may have a width of approximately 600 feet or greater and substantially unlimited length.

The dome building 10 illustrated in FIG. 1 has a network of external restraining members or elements 16 in the form of elongated cable members 34 connected in a polygonal pattern. The cable members 34 may comprise generally equal length metallic cables, such as wire cables or the braided strand type, fabric cables, fiberglass cables or leather cables having sufficient tensile strength to withstand the tensile forces necessary to restrain pressurized inflation of the form. The polygonal pattern of cables 34 includes a plurality of hexagonal and pentagonal shaped polygons of equal length sides. Each side of each polygon is common to an immediately adjacent polygon except for the bottom most polygons peripherally of the restraining cable network and adjacent the foundation 12. In the restraining cable network employed in the embodiment of FIG. 1, a pentagonal shaped polygon is disposed at the apex of the dome, and five pentagonal shaped polygons are disposed in the lowermost ring of polygons in equal circumferentially spaced relation. The remaining polygons are hexagonal.

Figure 5:
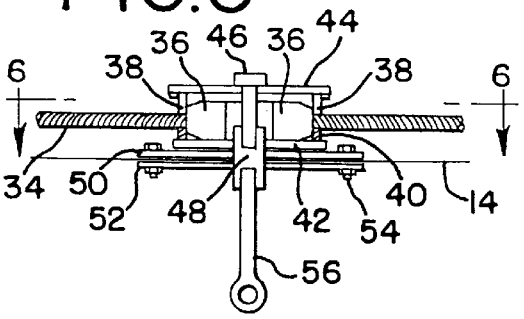
FIG. 5 is a fragmentary sectional view, taken substantially along line 5—5 of FIG. 6, illustrating the manner of connecting a plurality of external cable-like restraining members at a node point externally of the inflatable form.
Figure 6:
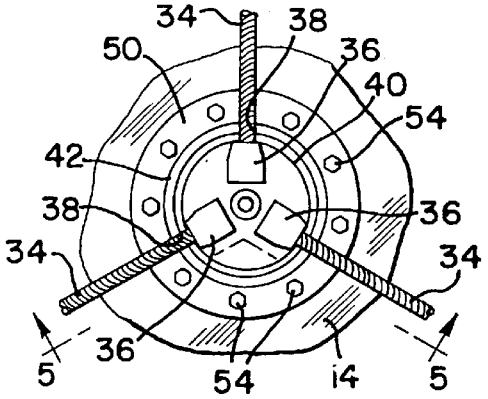
FIG. 6 is a fragmentary sectional view taken substantially along line 6—6 of FIG. 5.

FIGS. 5 and 6 illustrate one example of a technique for connecting the ends of three cable members 34 that form a common corner or node of three adjacent cable polygons as shown in FIG. 1. The end of each cable 34 has a enlarged head 36 fixed thereon, as by welding or swaging. Each of the three cables is then inserted into one of three slots 38 formed in equally spaced relation about an annular retaining ring 40 that is fixed on a circular connector plate 42. A retaining plate 44 is releasably secured against the outer edge of the retaining ring 40 by a screw 46 so as to retain the cables 34 within the slots 38 in the retaining ring. Screw 46 is threaded into a double ended threaded connector 48 fixed within a central opening in a circular plate 50. Plate 50 is releasably connected to a similar circular plate 52 through screws 54 with the inflatable form 14 sandwiched therebetween at a predetermined position or node point on the inflatable form. The plate 52 also has a center opening to receive the connector 48, as does the inflatable form 14, so that a threaded bore end of the connector 48 extends inwardly of the form when inflated. A hook-like or eyelet support rod 56 is adapted for threaded connection to the inner end of the connector 48 at each common corner cable connection or node of the restraining cable network so as to extend internally of the form 14 when inflated. The support rods 56 serve to support wire mesh in constructing internal ribs in underlying relation to the external network of restraining cables 34, as will be described.

Figure 7:
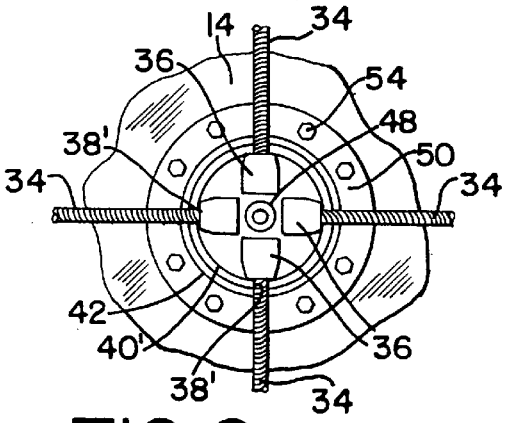
FIG. 7 is a fragmentary sectional view similar to FIG. 6 but illustrating a common connection of the ends of four cable-like restraining members in overlying relation to the inflatable form.

FIG. 7 illustrates a connector arrangement for connecting four cable members 34 at a node position on a underlying inflatable form 14. The connector arrangement illustrated in FIG. 7 is generally similar to the cable connector arrangement illustrated in FIGS. 5 and 6 except that it employs a retaining ring 40' having four slots 38' formed at 90° angular positions about the retaining ring to receive the cable members with their enlarged heads 36 retained internally of the ring 40'. The cable members 34 and corresponding enlarged heads 36 are retained within the slots in the retaining ring 40' by a circular retaining plate similar to the retaining plate 44 shown in FIG. 5 and which is removed from FIG. 7 for clarity. The cable member connector arrangement illustrated in FIG. 7 is employed in restraining cable networks employing lengths of cable intersecting at generally right angles to each other.

Figure 8:
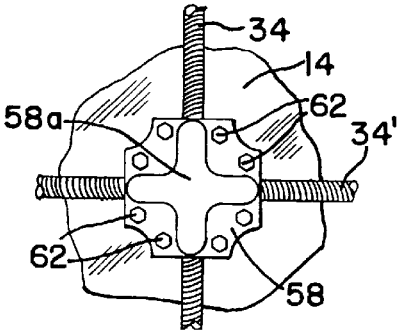
FIG. 8 is a fragmentary plan view of a connector assembly for securing transversely disposed external cable-like restraining members in overlapping relation.
Figure 9:
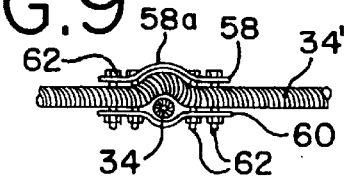
FIG. 9 is a fragmentary sectional view taken substantially along line 9—9 of FIG. 8.

FIGS. 8 and 9 illustrate another cable connector technique for securing two cable members in overlying generally 90° relation to each other as, for example, when interconnecting a cable member 34 extending generally radially relative to the apex of a dome building to a cable 34' extending circumferentially about the periphery of the inflated dome at generally right angles to the radial cables. The cable connector arrangement shown in FIGS. 8 and 9 includes a pair of upper and lower plates 58 and 60 which are substantially similar in construction and include outwardly deformed or contoured generally cross-shaped central portions 58*a* and 60*a*, respectively. The upper and lower plates 58 and 60 are connected through screws 62 with a pair of 90° oriented overlying cables 34 and 34' captured between the plates.

Figure 10:
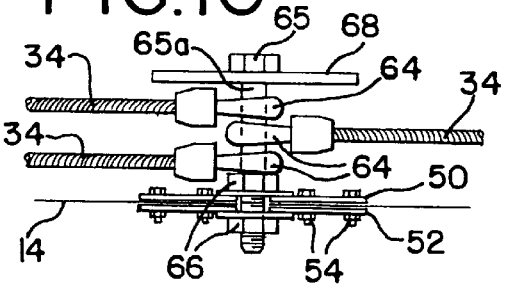
FIG. 10 is a fragmentary sectional view similar to FIG. 5 but illustrating an alternative arrangement for connecting the ends of three cables together.

FIG. 10 illustrates an alternative arrangement for connecting three cables 34 at a common connection or node point such as at the various corners of the polygonal network of cables shown in FIG. 1. As shown in FIG. 10, the three cables 34 each have an eyelet connector 64 fixed on its end. The eyelets are inserted over a connector shaft or bolt 65 having a threaded end 65*a* inserted through central openings in a pair of circular plates 50 and 52 that are secured together by screws 54 with the form 14 sandwiched therebetween similar to the cable connector arrangements illustrated in FIGS. 5–7. A pair of nuts 66 fix the bolt 65 to the plates 50 and 52. An annular retainer plate 68 is mounted on the bolt 65 between the bolt head 65 and the top-most cable eyelet connector 64 to retain the cable.

Figure 4B:
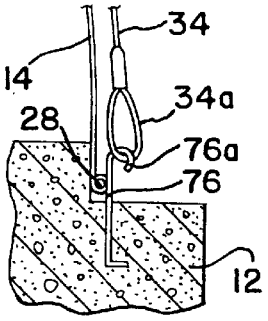
Figure 4C:
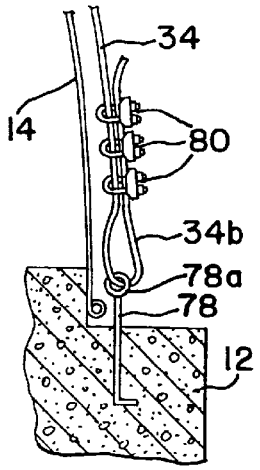

As aforedescribed, the network of cable members or elements 34 is releasably secured or anchored at its lower perimeter to the footing or foundation 12 so that the cable network will restrain outward inflation of the form 14. FIGS. 4A–4C illustrate various techniques for releasably securing or anchoring the periphery of the cable network to the footing or foundation 12. The cable network anchoring arrangement illustrated in FIG. 4A employs a generally L-shaped connector 70 anchored in the concrete foundation 12 and having a generally U-shaped upper end 70*a* adapted to receive an eyelet type connector 72 fixed to a lower end of a cable member 34. A connector pin 74 is inserted through aligned holes formed in the connector end 70*a* of the anchor member 70 and through the eyelet connector 72 to releasably retain the cable 34 connected to the anchor 70.

FIG. 4B illustrates an alternative manner of anchoring the cable network to the foundation 12 wherein a generally L-shaped anchor rod 76 is anchored within the concrete foundation 12 and has a hook-shaped upper end 76*a*. The hook-shaped end 76*a* is adapted to releasably receive a looped end 34*a* of a cable member 34 so as to releasably connect the cable member and associated cable network to the foundation.

FIG. 4C illustrates a further arrangement for anchoring a cable 34 to the foundation 12 wherein a generally L-shaped anchor member 78 is fixed to the foundation and has an upper eyelet end 78*a* to which a looped end 34*b* of the cable is secured. The free end of the looped cable is fixed upon itself through U-shaped connectors 80.

Figure 3:
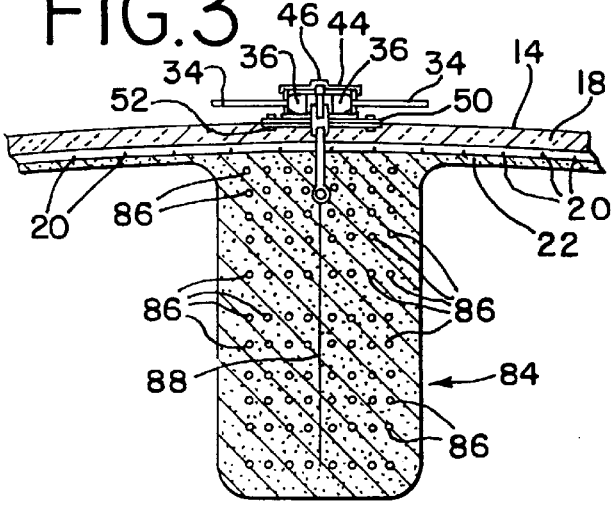
FIG. 3 is fragmentary transverse sectional view, on an enlarged scale, through the wall of the dome of FIG. 1 and is representative of the manner of forming an internal rib within the dome to underlie an external restraining cable member.

In accordance with one feature of the present invention, and to enable the construction of relatively large size self-supporting dome buildings, a network of ribs is formed internally of the dome so as to underlie the exterior network 16 of restraining cable members 34. The internal ribs, one of which is indicated at 84 and shown in cross-section in FIG. 3, facilitate self-support of the dome after release of air pressure from within the inflatable form 14. The ribs 84 are built up generally simultaneously with build up of the cementitious layer 22 on the inner surface of the foam layer 18 with the rebar or reinforcing mesh 20 embedded within the cementitious layer. Depending on the cross-sectional size of the ribs 84 needed to support the finished dome, the internal ribs 84 are formed by initially attaching a relatively lightweight cage of reinforcing mesh or rebar 86 to the inner surface of the foam layer 18, as by hanger bars similar to hanger bars 24, simultaneously with attaching the reinforcing mesh or rebar 20 to the foam layer. As the cementitious layers are progressively applied to the foam layer 18 to embed the rebar 20, the cementitious material is progressively applied, as by spraying, to the rib cage rebar 86. The rib cage reinforcing bars 86 are progressively built up or added in number along with spraying of cementitious layers onto the rib reinforcing bars to gradually build the internal ribs 84 to a predetermined size sufficient to support the weight of the dome when the internal pressure is released.

Preferably, the ribs 84 are attached to the node points of the external network 16 of restraining cables 34 by securing a suitable strength wire mesh 88 to the support rod 56 at each node of the external restraining cable network. The wire mesh 88 is positioned to extend generally radially inwardly from the inflated form 14 and lie centrally of the cage of reinforcing bars 86 so as to be embedded by the cementitious material applied to the cage rebar. As the ribs 84 are progressively built up, additional rebar can be added to the initial lightweight rebar cages and additional layers of cementitious material applied, as by spraying, to build up the internal ribs to their desired size. For example, it is estimated that for a dome building having a base diameter of approximately five hundred fifty feet, internal ribs having horizontal widths of approximately eighteen inches and radial depths of approximately four feet will provide the necessary internal support for the finished dome when the form inflating air pressure is released from internally of the dome. By connecting the internal ribs 84 to the node points of the external network 16 of cable members 34 through the reinforcing mesh 88 and support rods 56, the internal pressure acting against the inflatable form 14, and thereby against the external network of restraining cable members, will assist in supporting the point loads of the internal ribs until the cementitious ribs have set and are strong enough to carry their own weight and the weight of the completed dome building. By varying the thickness and depth of the internal ribs, their load capacity can be varied depending upon the size of the dome building to be constructed. If desired, all or selected ones of the external cables 34 and their associated corner connector arrangements may be removed from the dome after it becomes self-supporting. Removal of all of the cables enables removal of the inflatable form 14 for re-use.

Figures 11, 12, 13, 14, 15, 16:
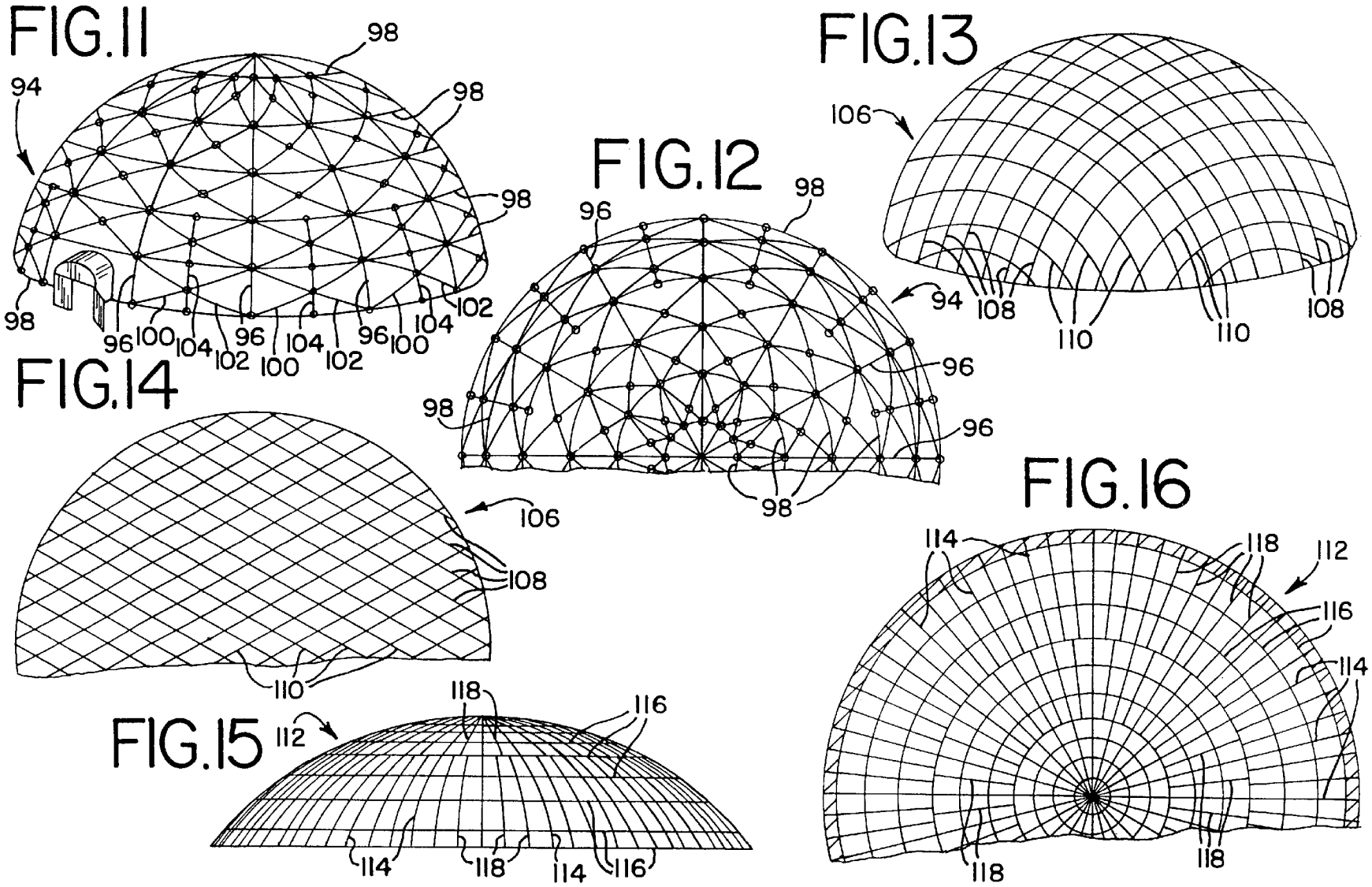
FIG. 11 is a perspective view schematically illustrating a dome building structure in accordance with another embodiment of the invention having an external network of restraining cables taking the form of a modified radial cable arrangement.
FIG. 12 is a fragmentary plan view of the dome building structure of FIG. 10.
FIG. 13 is a perspective view schematically illustrating a dome building structure in accordance with another embodiment of the invention having an external network of restraining cables taking the form of a modified great circle cable arrangement.
FIG. 14 is a fragmentary plan view of the dome building structure of FIG. 13.
FIG. 15 is an elevational view schematically illustrating a dome building structure in accordance with still another embodiment of the invention having an external network of restraining cables taking the form of generally radial and circumferential restraining cables.
FIG. 16 is a fragmentary plan view of the dome building structure of 15.

FIGS. 11–16 illustrate alternative patterns or arrangements for configuring the external network of restraining cable members as alternatives to the polygonal cable network pattern shown in FIG. 1. FIGS. 11 and 12 schematically illustrate a dome type building 94 having a plurality of generally radially extending external restraining cables 96 that extend from the apex of the dome to a base or foundation (not shown). A plurality of circumferential restraining cables 98 extend about the periphery of the dome in vertical spaced relation to each other and are preferably interconnected to the radial cable members 96 in generally transverse relation thereto through suitable connector means at the points or nodes of overlying relation. Additionally, a generally X-shaped cable arrangement may be provided within the generally rectangular areas defined by the intersecting cable members 96 and 98, as exemplified by the restraining cable members 100 and 102. Shorter length radial cable members 104 may be connected to and between the lowermost circumferential cable 98 and higher elevation circumferential cables 98.

FIGS. 13 and 14 schematically illustrate a dome building, indicated generally at 106, having an external restraining cable network or arrangement taking the form of a first plurality of restraining cables 108 lying in parallel vertical planes and traversed by a second plurality of restraining cables 110 lying in parallel vertical planes generally transverse to the planes containing the restraining cables 108. This network of external restraining cables is exemplified by one cable of each group of parallel cables lying on the great circle of the generally semi-spherical dome building 106 and the remaining cables of each group lying in planes parallel to the great circle cable.

FIGS. 15 and 16 schematically illustrate another embodiment of a dome building, indicated generally at 112, that employs an external restraining cable network or arrangement including a plurality of radially extending restraining cable members 114 that extend from the apex of the dome to the base thereof, a plurality of circumferentially extending cable members 116 lying in vertically spaced horizonal planes and being disposed in generally transverse relation to the restraining cables 114 and connected thereto at their points of overlap, and a plurality of generally radially extending restraining cables 118 that extend only a portion of the distance from the base of the dome to the apex thereof.

Figure 17:
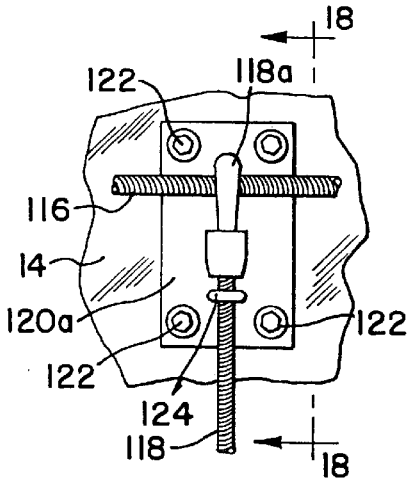
FIG. 17 is a fragmentary elevational view illustrating a connection of a generally radial external restraining cable to a circumferential cable as employed in FIG. 15.
Figure 18:
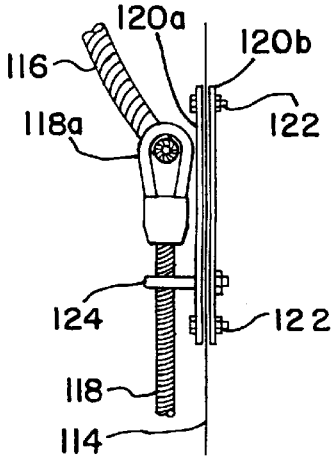
FIG. 18 is a fragmentary vertical sectional view taken substantially along line 18—18 of FIG. 17.

FIGS. 17 and 18 illustrate an arrangement for connecting the upper ends of the shorter length generally radial cables 118 to a circumferential cable 116. As shown, a pair of rectangular plates 120*a* and 120*b* are connected to the form 14 by fastener screws 122 to underlie the point or node at which the cable 118 will be connected to a circumferential cable 116. The cable 116 is inserted through an eyelet connector 118*a* fixed on the upper end of each cable 118. A U-bolt 124 is secured to the plates 120*a,b* so as to retain the cable 118 in generally fixed relation to the plate 120*a*. The cables 114, 116 and 118 may be connected at their points or nodes of transverse overlap by suitable connector means as illustrated in FIGS. 8 and 9. In this manner, the network of external cables 114, 116 and 118 are suitable secured together to enable inflation of form 14 but restrain it from expanding sufficiently to tear or rip under the inflation pressure.

Thus, in accordance with the present invention, a dome structure is provided that utilizes an inflatable form and a network of external restraining cable members that enable inflation of the form to a desired dome configuration while restraining outward inflation of the form so as to prevent rupture or tearing of the form. A layer of foam is applied to the inner surface of the inflated form followed by attachment of reinforcing mesh or rebar to the cured foam layer. A cementitious material is progressively applied to the inner surface of the foam layer, as by spraying, to embed the rebar within the cementitious layer. Internal ribs are simultaneously built up within the dome so as to underlie the external network of restraining cables. The inner ribs are of sufficient size to support the dome when the air pressure is relieved from the internally of the inflatable form. This enables dome buildings free of internal support columns to be constructed of substantially greater size than has heretofore been possible. It will be understood that the various described connector arrangements for interconnecting the external restraining cables are illustrative, and that other suitable connection techniques may also be employed.

While preferred embodiments of the present invention have been illustrated and described, it will be understood to those skilled in the art that changes and modifications may be made therein without departing from the invention in its broader aspects. Various features of the invention are defined in the following claims.

I claim:

1. A method of constructing a dome building comprising the steps of securing a peripheral edge of an inflatable form to a base, securing a network of external flexible cable restraining members to the base so that the restraining members overlie said form, inflating said form under pressure into a dome shape so that outward expansion of the form is restricted by said restraining members being placed in longitudinal tension, forming a layer of insulation foam material on an inner surface of the inflated form, securing a reinforcing mesh to an inner surface of said foam layer, applying one or more layers of a cementitious material to the inner surface of said foam layer to a depth sufficient to embed said reinforcing mesh, forming a network of reinforcing bars internally of said foam layer so that said reinforcing bars generally underlie said external network of restraining members, applying one or more layers of cementitious material to said network of reinforcing bars to a depth sufficient to embed said reinforcing bars so that cementitious ribs are formed by said embedded reinforcing bars to underlie said external network of restraining members, and relieving pressure from internally of said form after said cementitious material has set so that a self-supporting dome is formed independently of said restraining members.

2. The method as defined in claim 1 including the step of securing a plurality of hanger members to said foam layer, each of said hanger members having a hanger rod projecting inwardly from said foam layer, said step of securing said reinforcing mesh to said foam layer including attaching said mesh to said hanger rods.

3. The method as defined in claim 2 wherein each of said hanger members include a base portion disposed against said foam layer, and including the step of applying a second layer of insulation foam material to the inner exposed surface of the first applied layer of foam so as to imbed said base portions within said foam material.

4. The method as defined in claim 1 wherein said external network of restraining members comprises a network of elongated cable-like members having cooperative relation with said inflatable form so as to enable inflation of said form to a greater internal pressure than permissible without said restraining members.

5. The method of claim 4 wherein said elongated cable-like members are selected from the group consisting of metallic cables, fabric cables, fiberglass cables and leather cables.

6. The method as defined in claim 1 wherein said restraining members comprise elongated metallic cables.

7. The method as defined in claim 1 wherein said network of external restraining members comprises a plurality of elongated cables interconnected in a polygonal array, and including the step of anchoring selected ones of said cables to the base so that said polygonal array of cables overlies said inflatable form.

8. The method as defined in claim 7 wherein said polygonal array of cables defines a plurality of interstices of sufficient size to allow said inflatable form to extend convexly outwardly through said interstices when inflated to an internal pressure sufficient to cause said cables to restrain inflation of the form.

9. The method as defined in claim 1 wherein said form has a generally circular periphery secured to said base, said form being configured to establish a dome shape when inflated against the restraining members, said restraining members comprising a plurality of first cables extending generally radially from the apex of the dome shape to the base, and a plurality of second cables extending substantially circumferentially of the dome shape generally concentric with the apex thereof, said first and second cables being in generally transverse overlapping relation and secured together at points of overlapping.

10. The method as defined in claim 1 including the step of interconnecting said external restraining members to said internal ribs through said inflatable form.

11. The method as defined in claim 1 wherein said network of external restraining members comprises a plurality of elongated cable-like elements interconnected in a polygonal array.

12. The method as defined in claim 1 wherein said network of external restraining members comprises a first plurality of elongated flexible cable-like elements extending generally radially from the apex of said dome shape, and a second plurality of elongated flexible cable-like elements extending generally in a great circle parallel pattern generally transverse to said first plurality of cable-like elements.

13. A dome structure made in accordance with the method of claim 1.

14. A method of constructing a dome building comprising the steps of securing a peripheral edge of an inflatable form to a base, securing a network of external restraining members to the base so that the restraining members overlie said form, inflating said form under pressure into a dome shape so that outward expansion of the form is restricted by said restraining members, forming a layer of insulation foam material on an inner surface of the inflated form, securing a reinforcing mesh to an inner surface of said foam layer, applying one or more layers of a cementitious material to the inner surface of said foam layer to a depth sufficient to embed said reinforcing mesh, forming a network of internal cementitious ribs integral with said one or more layers of cementitious material, said ribs being formed so as to directly underlie said external network of restraining members, relieving pressure from internally of said form after said cementitious material has set, and removing said external restraining members after said internal ribs have become self-supporting of the dome.

15. A dome structure made in accordance with the method of claim 14.

16. A dome building comprising, in combination, a base foundation, an air impervious form having a peripheral edge secured to said base, an external network of flexible cable-like members secured to said base and overlying said form, said form being inflated into a dome shape restrained by said cable-like members, a layer of insulating foam formed on the inner surface of said inflated form, a reinforced cementitious layer on the inner surface of the foam layer, a network of reinforcing bars adjacent said reinforced cementitious layer generally underlying said external network of cable-like members, and a cementitious material embedding said reinforcing bars so as to form internal ribs integral with said reinforced cementitious layer underlying said external network of cable-like members.

17. A dome building as defined in claim 16 wherein said internal ribs are formed from a cementitious material, said external network of cable-like members including discrete lengths of cable interconnected at node points, and including means selectively interconnecting said node points of said external network of cables to said internal ribs to assist in support of the ribs until they become self-supporting of the dome.

18. A dome building as defined in claim 17 wherein said external network of cable-like members has a polygonal configuration.

19. A dome building as defined in claim 17 wherein said external network of cable-like members includes a plurality of generally radially extending cables and a plurality of circumferentially extending cables interconnected to said radially extending cables.

20. A dome building as defined in claim 16 wherein said external network of cable-like members is configured to allow the form to extend convexly outwardly or pooch through interstices in the cable network.

21. A dome building as defined in claim 16 wherein said internal ribs are formed from a cementitious material integral with said cementitious layer, said ribs including reinforcing bars embedded in said cementitious rib material.

22. A method of constructing a dome building comprising the steps of securing a peripheral edge of an inflatable form to a base, securing a network of external flexible cable restraining members to the base so that the restraining members overlie said form, inflating said form under pressure into a dome shape so that outward expansion of the form is restricted by said restraining members being placed in longitudinal tension, forming a layer of insulation foam material on an inner surface of the inflated form, securing a reinforcing mesh to an inner surface of said foam layer, forming a network of reinforcing bars internally of said foam layer so that said reinforcing bars generally underlie said external network of restraining members, applying one or more layers of cementitious material to the inner surface of said foam layer and to said network of reinforcing bars to a depth sufficient to embed said reinforcing mesh and said reinforcing bars so that said embedded reinforcing bars form ribs underlying said external network of restraining members, and relieving pressure from internally of said form after said cementitious material has set so that a self-supporting dome is formed independently of said restraining members.

23. A dome structure made in accordance with the method of claim 22.

* * * * *